US009441472B2

(12) United States Patent
Wright et al.

(10) Patent No.: US 9,441,472 B2
(45) Date of Patent: Sep. 13, 2016

(54) HYDROCARBON RESOURCE HEATING SYSTEM INCLUDING COMMON MODE CHOKE ASSEMBLY AND RELATED METHODS

(71) Applicant: Harris Corporation, Melbourne, FL (US)

(72) Inventors: Brian Wright, Indialantic, FL (US); Murray Hann, Malabar, FL (US); Raymond C Hewit, Palm Bay, FL (US); Verlin Hibner, Melbourne Beach, FL (US); Mark Trautman, Melbourne, FL (US); John Emory White, Melbourne, FL (US)

(73) Assignee: HARRIS CORPORATION, Melbourne, FL (US)

( * ) Notice: Subject to any disclaimer, the term of this patent is extended or adjusted under 35 U.S.C. 154(b) by 302 days.

(21) Appl. No.: 14/167,039

(22) Filed: Jan. 29, 2014

(65) Prior Publication Data

US 2015/0211336 A1 Jul. 30, 2015

(51) Int. Cl.
*E21B 43/24* (2006.01)
*E21B 47/12* (2012.01)

(52) U.S. Cl.
CPC ..... *E21B 43/2401* (2013.01); *E21B 43/24* (2013.01); *E21B 47/122* (2013.01)

(58) Field of Classification Search
CPC ..... E21B 36/00; E21B 36/04; E21B 43/24; E21B 43/2401; E21B 47/122; E21B 43/00; E21B 43/003; E21B 43/2408; E21B 41/00; H01Q 1/04; H01Q 9/24; H05B 6/62; H05B 2214/03; Y10T 29/53
See application file for complete search history.

(56) References Cited

U.S. PATENT DOCUMENTS

| | | | | |
|---|---|---|---|---|
| 3,498,381 | A * | 3/1970 | Earlougher, Jr. | E21B 36/00 166/303 |
| 5,065,819 | A | 11/1991 | Kasevich | |
| 5,293,936 | A | 3/1994 | Bridges | |
| 7,441,597 | B2 | 10/2008 | Kasevich | |
| 7,891,421 | B2 | 2/2011 | Kasevich | |
| 2006/0044103 | A1 | 3/2006 | Rebke et al. | |
| 2006/0044742 | A1 | 3/2006 | Kaishian et al. | |
| 2010/0078163 | A1 | 4/2010 | Banerjee et al. | |
| 2010/0294489 | A1 | 11/2010 | Dreher, Jr. et al. | |
| 2012/0067580 | A1 * | 3/2012 | Parsche | E21B 43/2401 166/302 |
| 2013/0334205 | A1 | 12/2013 | Wright | |

OTHER PUBLICATIONS

U.S. Appl. No. 13/756,756, filed Feb. 1, 2013.
U.S. Appl. No. 14/076,501, filed Nov. 11, 2013.
U.S. Appl. No. 13/756,774, filed Feb. 1, 2013.

* cited by examiner

*Primary Examiner* — Yong-Suk (Philip) Ro
(74) *Attorney, Agent, or Firm* — Allen, Dyer, Doppelt, Milbrath & Gilchrist, P.A.

(57) ABSTRACT

A system for heating a hydrocarbon resource in a subterranean formation having a wellbore extending therein may include a radio frequency (RF) antenna configured to be positioned within the wellbore, an RF source, a cooling fluid source, and a transmission line coupled between the RF antenna and the RF source. A plurality of ring-shaped choke cores may surround the transmission line, and a sleeve may surround the ring-shaped choke cores and define a cooling fluid path for the ring-shaped choke cores and in fluid communication with the cooling fluid source.

21 Claims, 14 Drawing Sheets

HYDROCARBON RESOURCE HEATING SYSTEM INCLUDING COMMON MODE CHOKE ASSEMBLY AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RF source, transmission line, and/or antenna, resulting in common mode current interference, for example. These mismatches become particularly acute with increased heating of the subterranean formation. Moreover, such applications may require high power levels that result in relatively high transmission line temperatures that may result in transmission failures.

SUMMARY OF THE INVENTION

A system for heating a hydrocarbon resource in a subterranean formation having a wellbore extending therein may include a radio frequency (RF) antenna configured to be positioned within the wellbore, an RF source, a cooling fluid source, and a transmission line coupled between the RF antenna and the RF source. A plurality of ring-shaped choke cores may surround the transmission line, and a sleeve may surround the plurality of ring-shaped choke cores and define a cooling fluid path for the plurality of ring-shaped choke cores and in fluid communication with the cooling fluid source.

More particularly, in some embodiments, a tubular may surround the transmission line, and the plurality of ring-shaped choke cores may surround the tubular. Furthermore, the transmission line may comprise a coaxial transmission line also coupled in fluid communication with the cooling fluid source. The system may also include a plurality of baffles, each spacing an adjacent pair of ring-shaped chokes apart to further define the cooling fluid path. By way of example, each baffle may comprise a ring-shaped dielectric body having at least one cooling fluid opening therethrough. At least some of the cooling fluid openings may be radially outer relative to adjacent ring-shaped chokes, and at least some of the cooling fluid openings may be radially inner relative to adjacent ring-shaped chokes.

The plurality of ring-shaped choke cores may comprise a first group of ring-shaped choke cores each having a first width, and a second group of ring-shaped choke cores each having a second width different than the first width. Additionally, the plurality of ring-shaped choke cores may comprise a first group having a first spacing between corresponding adjacent ring-shaped chokes, and a second group having a second spacing between corresponding adjacent ring-shaped choke cores different than the first spacing. By way of example, the sleeve may comprise a dielectric material, and the plurality of ring-shaped choke cores may each comprise a nanocrystalline magnetic material.

A related choke assembly to be coupled with an RF antenna to be positioned within a wellbore in a subterranean formation to heat a hydrocarbon resource is also provided. The choke assembly may include a transmission line to be coupled between the RF antenna and an RF source, a plurality of ring-shaped choke cores surrounding the transmission line, and a sleeve surrounding the plurality of ring-shaped choke cores and defining a cooling fluid path for the plurality of ring-shaped choke cores to be connected in fluid communication with a cooling fluid source.

A related method is for heating a hydrocarbon resource in a subterranean formation having a wellbore extending therein. The method may include positioning a plurality of ring-shaped choke cores surrounding a transmission line, and positioning a sleeve surrounding the plurality of choke cores and defining a cooling fluid path for the plurality of ring-shaped choke cores. The method may also include positioning an RF antenna and the transmission line within the wellbore so that the transmission line is coupled with the RF antenna. Furthermore, the cooling fluid circuit may be coupled in fluid communication with a cooling fluid source, and an RF signal may be applied to the transmission line using an RF source.

DETAILED DESCRIPTION OF THE EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in different embodiments.

Figure 1:
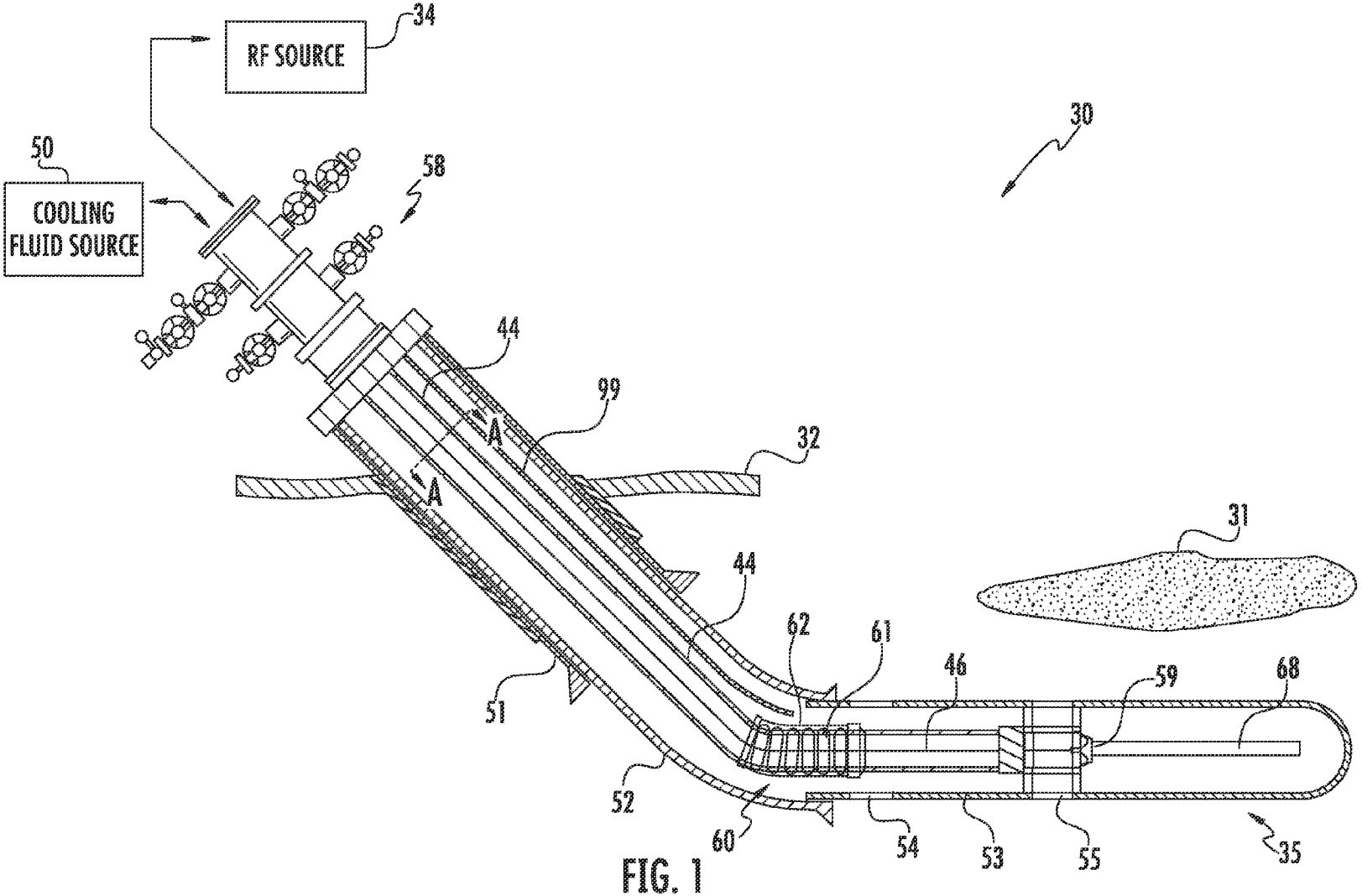
FIG. 1 is a schematic diagram of a system for heating a hydrocarbon resource in accordance with an example embodiment including a common mode choke assembly.
Figure 2:
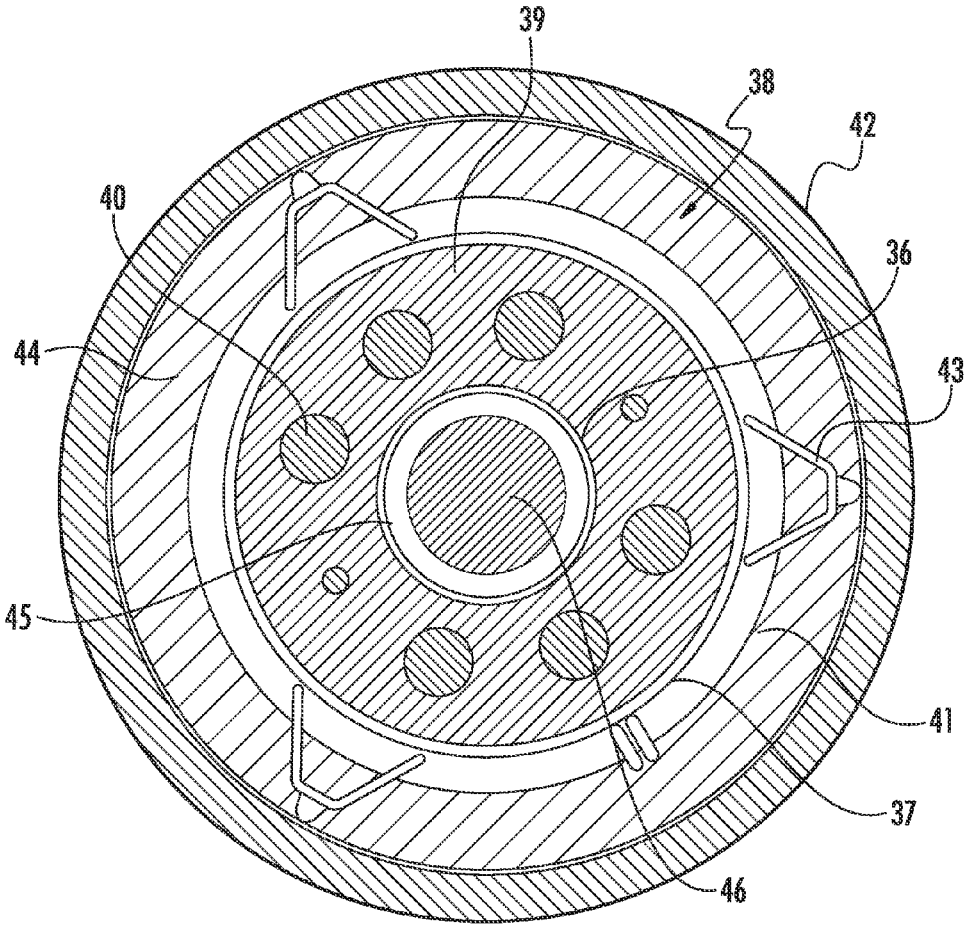
FIG. 2 is a cross-sectional diagram of the transmission line and accompanying tubular of the system of FIG. 1 taken along line A-A.
Figure 3:
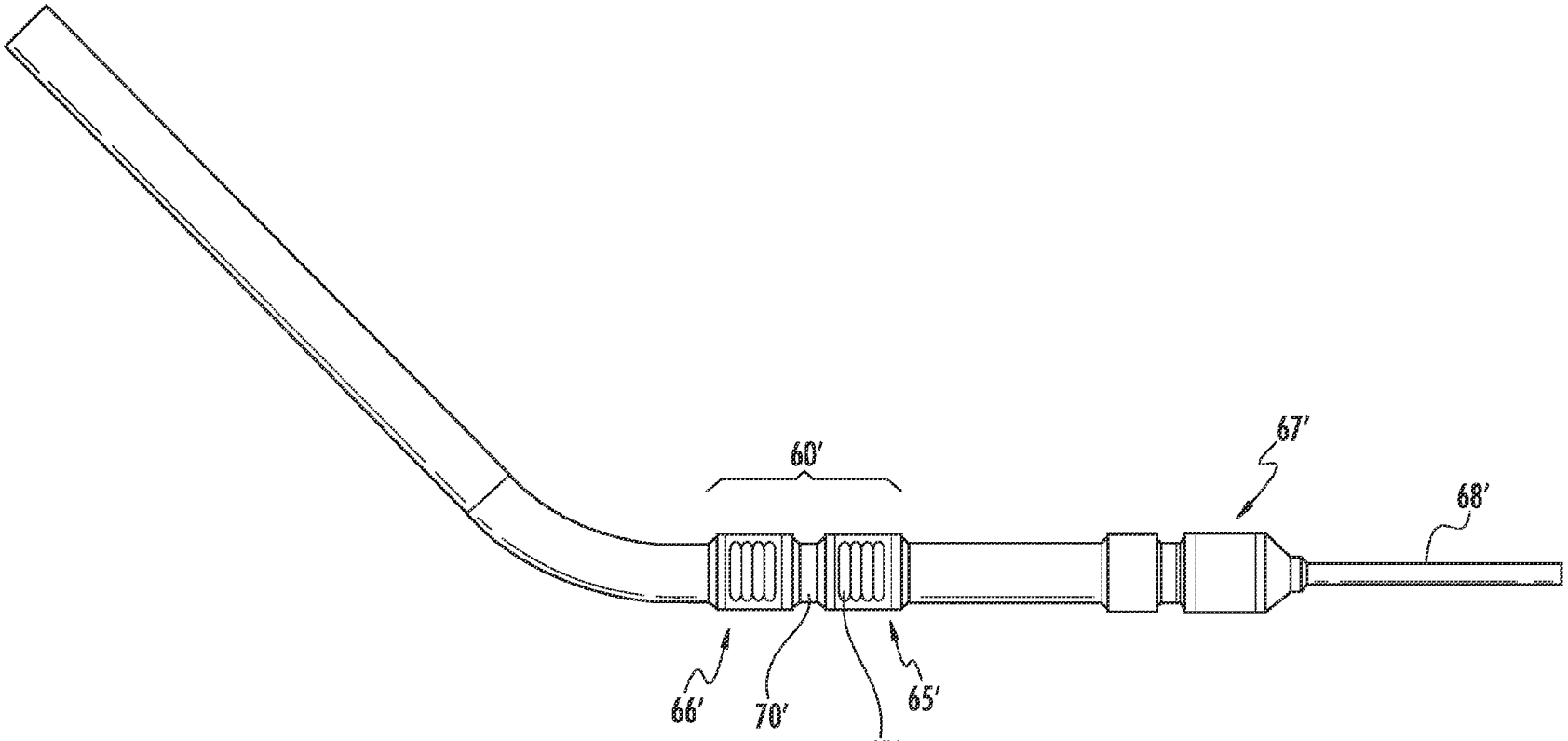
FIG. 3 is a schematic diagram of an alternative embodiment of the transmission line assembly of the system of FIG. 1 include another example common mode choke assembly.
Figure 4:
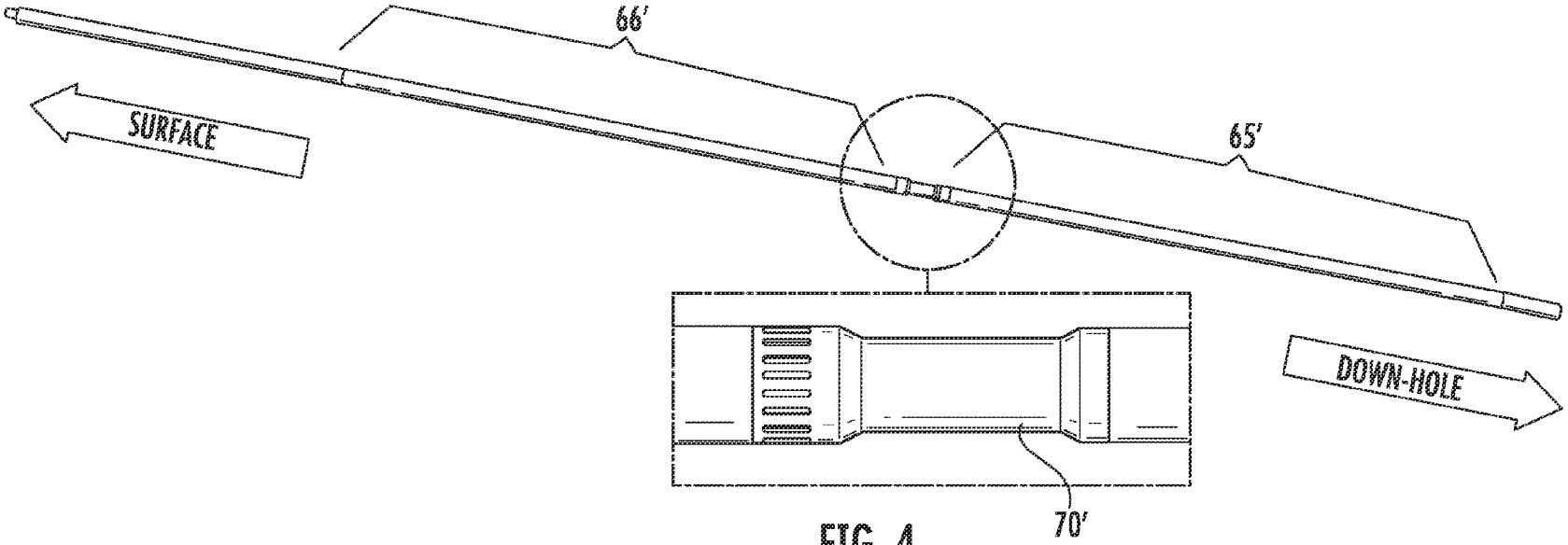
FIG. 4 is a perspective view of the common mode choke assembly of FIG. 3 with a bolted flange connection between common mode choke sections.
Figure 5:
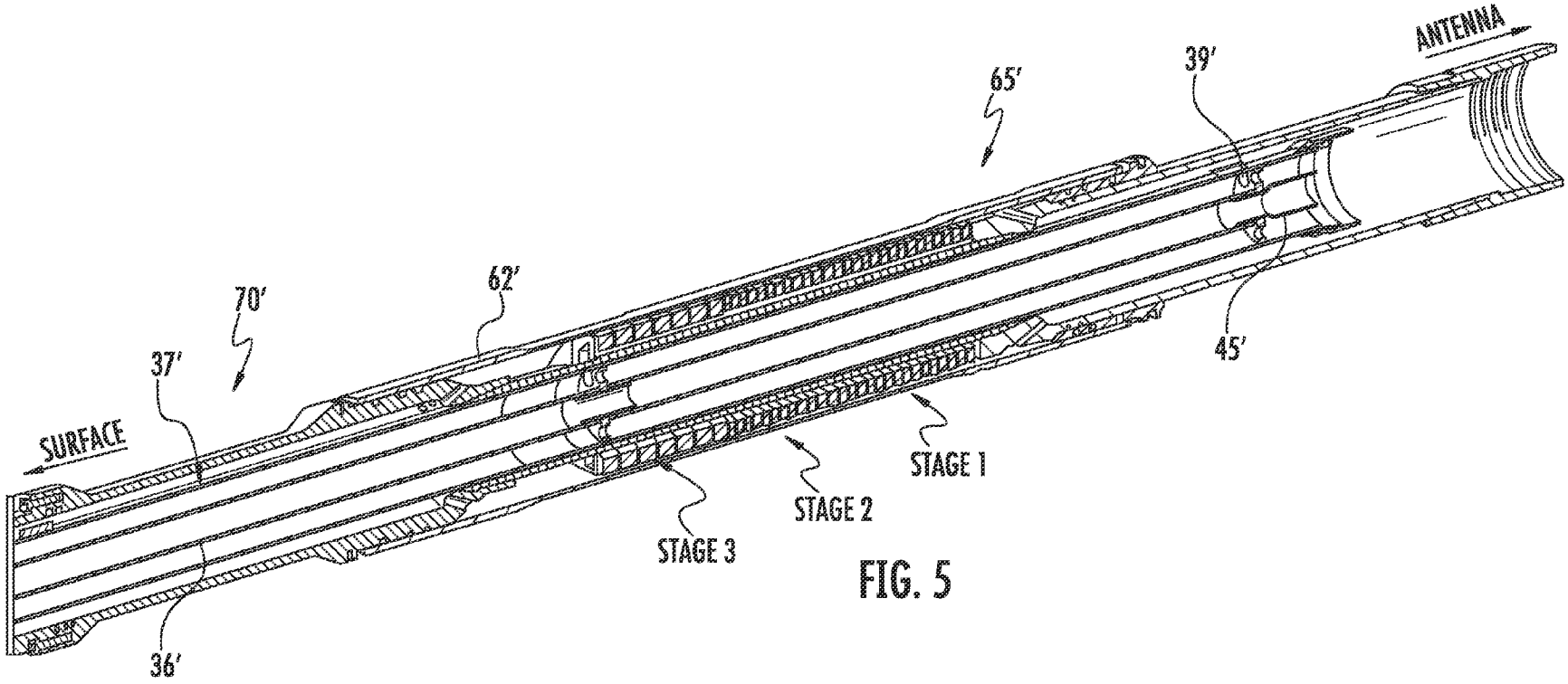
FIG. 5 is a cross-sectional perspective view of the first common mode choke section of the choke assembly of FIG. 4.
Figure 6:
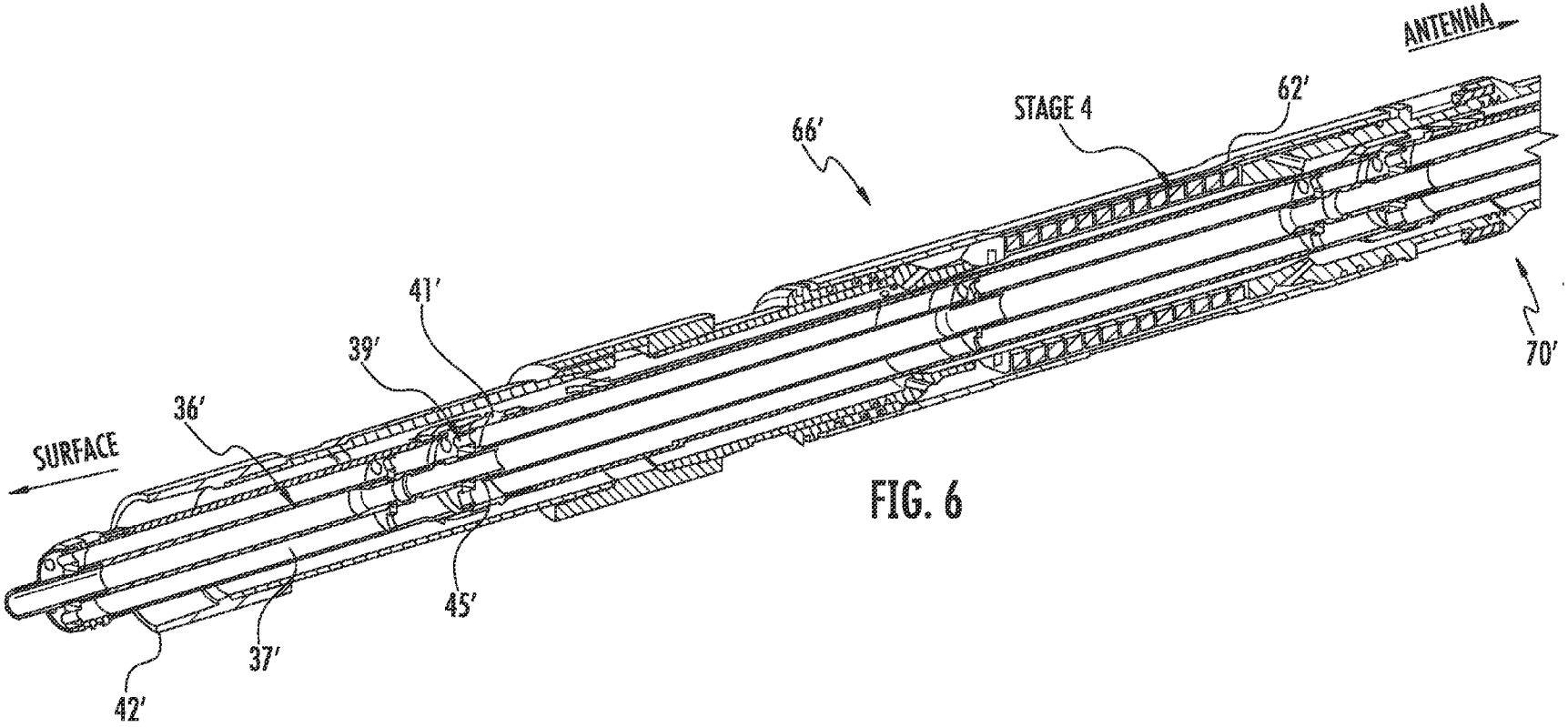
FIG. 6 is a cross-sectional perspective view of the second common mode choke section of the choke assembly of FIG. 4.

Referring initially to FIGS. 1 and 2, a system 30 for heating a hydrocarbon resource 31 (e.g., oil sands, etc.) in a subterranean formation 32 having a wellbore therein is first described. In the illustrated example, the wellbore is a laterally extending wellbore, although the system 30 may be used with vertical or other wellbores in different configurations. The system 30 further includes a radio frequency (RF) source 34 for an RF antenna or transducer 35 that is positioned in the wellbore adjacent the hydrocarbon resource 31. The RF source 34 is positioned above the subterranean formation 32, and may be an RF power generator, for example. In an exemplary implementation, the laterally extending wellbore may extend several hundred meters within the subterranean formation 32. Moreover, a typical laterally extending wellbore may have a diameter of about fourteen inches or less, although larger wellbores may be used in some implementations. Although not shown, in some embodiments a second or producing wellbore may be used below the wellbore, such as would be found in a SAGD implementation, for collection of petroleum, bitumen, etc., released from the subterranean formation 32 through heating.

A coaxial transmission line 38 extends within the wellbore 33 between the RF source 34 and the RF antenna 35. The transmission line 38 includes an inner conductor 36, an outer conductor 37, and one or more radial support members 39 positioned between the inner and outer conductors. In the illustrated example, the radial support member 39 illustratively includes a plurality of openings 40 which may be used for fluid tubes, gas flow, etc. For example, the space between the inner conductor 36 and the outer conductor 37 may be filled with an insulating gas, such as nitrogen, if desired.

A transmission line segment coupler 41 is carried on the outer conductor 37, and a tubular 42 (e.g., a metal pipe) surrounds the outer conductor and is supported by spacers 43. A space between the outer dielectric 41 and the tubular 42 defines a passageway for supplying a cooling fluid 44 (e.g., mineral oil, etc.) from a cooling fluid source 50 coupled to a well head 51. Furthermore, a support member 45 is positioned radially inside the inner conductor 36, and the space inside the inner dielectric defines a passageway which may be used for returning heated cooling fluid 46 to the cooling fluid source 50 at the well head 51, as will be discussed further below (although the cooling fluid flow may be reversed in some embodiments). By way of example, the cooling fluid source 50 may include one or more cooling fluid reservoirs and a pump(s) to circulate the cooling fluid throughout the cooling fluid circuit. Further details regarding exemplary transmission line 38 support and interconnect structures which may be used in the configurations provided herein may be found in co-pending application Ser. No. 13/525,877 filed Jun. 18, 2012, and Ser. No. 13/756,756 filed Feb. 1, 2013, both of which are assigned to the present Applicant and are hereby incorporated herein in their entireties by reference.

A surface casing 51 and an intermediate casing 52 may be positioned within the wellbore as shown. The RF antenna 38 may be coupled with the intermediate casing 52, and in the illustrated example the RF antenna includes a plurality of linear conductive portions 53, a tip isolator 54 adjacent the intermediate casing, and a center isolator 55 spaced apart from the tip isolator.

The RF source 34 may be used to differentially drive the RF antenna 35. That is, the RF antenna 35 may have a balanced design that may be driven from an unbalanced drive signal. Typical frequency range operation for a subterranean heating application may be in a range of about 100 kHz to 10 MHz, and at a power level of several megawatts, for example. However, it will be appreciated that other configurations and operating values may be used in different embodiments.

The transmission line 38 and tubular 42 may be implemented as a plurality of separate segments which are successively coupled together and pushed or fed down the wellbore. The system 30 further includes a common mode choke assembly 60 coupled to the transmission line 38 adjacent the RF antenna 35 within the wellbore. The RF antenna 35 may be installed in the well first, followed by the transmission line (and choke assembly 60) which is plugged into the antenna, thus coupling the transmission line to the antenna. A fluid turn-around portion 59 directs the supplied cooling fluid 44 from the cooling fluid source 50 into the passageway inside the inner conductor 45 to return the heated cooling fluid 46 to the cooling fluid source at the well head 51. Further details on an exemplary antenna structure which may be used with the embodiments provided here is set forth in co-pending application Ser. No. 14/076,501 filed Nov. 11, 2013, which is also assigned to the present Applicant and is hereby incorporated herein in its entirety by reference. However, it should be noted that in some embodiments the RF antenna assembly may be coupled to the transmission line at the wellhead and both fed into the wellbore at the same time, as will be appreciated by those skilled in the art.

Generally speaking, the common mode choke assembly 60 is used for common-mode suppression of currents that result from feeding the RF antenna 35. More particularly, the common mode choke assembly 60 may be used to confine much of the current to the RF antenna 35, rather than allowing it to travel back up the outer conductor 37 of the transmission line, for example, to thereby help maintain volumetric heating in the desired location while enabling efficient, safe and electromagnetic interference (EMI) compliant operation.

By way of background, because the wellbore diameter is constrained, the radiating antenna 35 and transmission line 38 are typically collinearly arranged. However, this results in significant coupling between the antenna 35 and outer conductor 37 of the transmission line 38. This strong coupling manifests itself in current being induced onto the transmission line 38, and if this current is not suppressed, the transmission line effectively becomes an extension of the radiating antenna 35, heating undesired areas of the geological formation 32. The common mode choke assembly 60, which in the illustrated example is carried on the tubular 42, advantageously performs the function of attenuating the induced current on the transmission line 38, effectively confining the radiating current to the antenna 35 proper, where it performs useful heating. More particularly, the current couples to the steel tubular 42, and the transmission line 38 is isolated from the current because it is fully surrounded by the tubular. However, it should be noted that in some embodiments the choke cores 61 may be carried on the outer conductor 37 of the transmission line 38, as will be appreciated by those skilled in the art.

Being able to accurately quantify choke losses is one technical challenge to evaluating the viability of a geological RF heating implementation. Moreover, the ability to provide adequate cooling of the choke may be significant due to the compact size of the choke assembly 60 within the wellbore, and the relatively high power densities (e.g., greater than 1 $W/cm^3$) and low thermal conductivity of the choke material. Other technical challenges may include: sufficiently attenuating high common mode currents without magnetic saturation; providing acceptable system efficiency (e.g., without dissipating too much power in the choke assembly 60); maintaining the operating temperature below a maximum service temperature; providing a form factor that is relatively compact radially and axially (i.e., wellbore "real estate" is typically at premium); compatibility with extant well completion technology; and robustness to withstand installation loads.

The choke assembly 60 may advantageously help overcome these technical challenges. In the illustrated example, the choke assembly 60 includes a plurality of ring-shaped or annular choke cores 61 surrounding one or more portions or sections of the transmission line 38. Furthermore, a sleeve 62 surrounds the plurality of ring-shaped choke cores 61 and defines a cooling fluid path for the plurality of ring-shaped choke cores which is in fluid communication with the cooling fluid source 50.

Referring additionally to FIGS. 3-13, another embodiment of a common mode choke assembly 60' including first and second spaced-apart choke sections 65', 66' is now described. In the illustrated embodiment, the common mode choke assembly 60' is coupled in-line with a tool head 67' having a lead spear attachment 68' (which is similar to the lead spear attachment 68 shown in FIG.1). The tool head 67' is to be coupled with the RF antenna at the center isolator (see FIG. 1). The choke mode assembly 60' is coupled in fluid communication with the cooling fluid source via the cooling fluid passageways in and around the transmission line described above with respect to FIG. 2. In the illustrated example, the first and second choke sections 65', 66' are coupled together via a bolted flange connection member 70' (see FIG. 4). This configuration may be desirable in that the bolted flange connection member 70' provides a joint to facilitate movement of the choke sections 65', 66' within the wellbore, as opposed to manipulating a longer, single choke assembly. In this regard, the choke assembly 60' may be divided over more than two sections in some embodiments, if desired.

Figure 7:
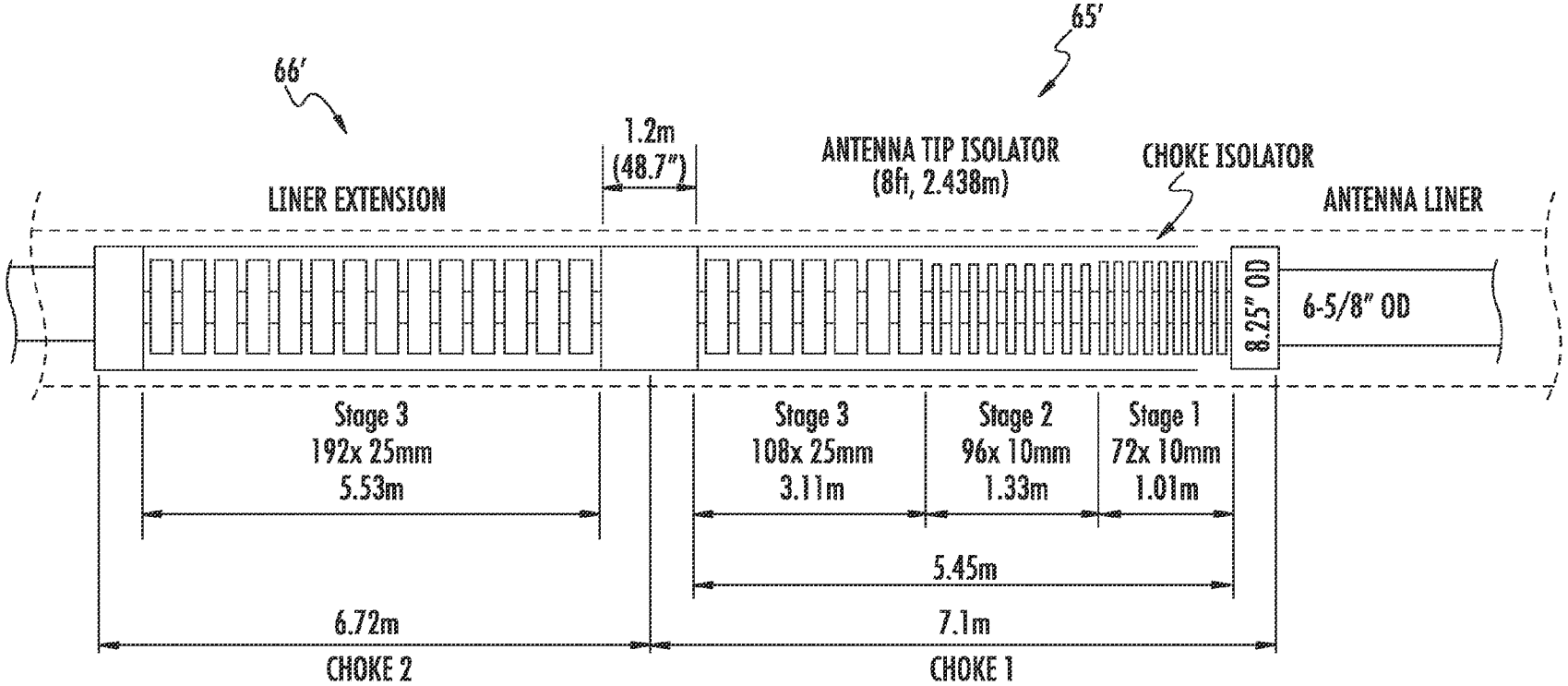
FIG. 7 is a schematic diagram showing example components and dimensions for the common mode choke assembly of FIG. 4.
Figure 8:
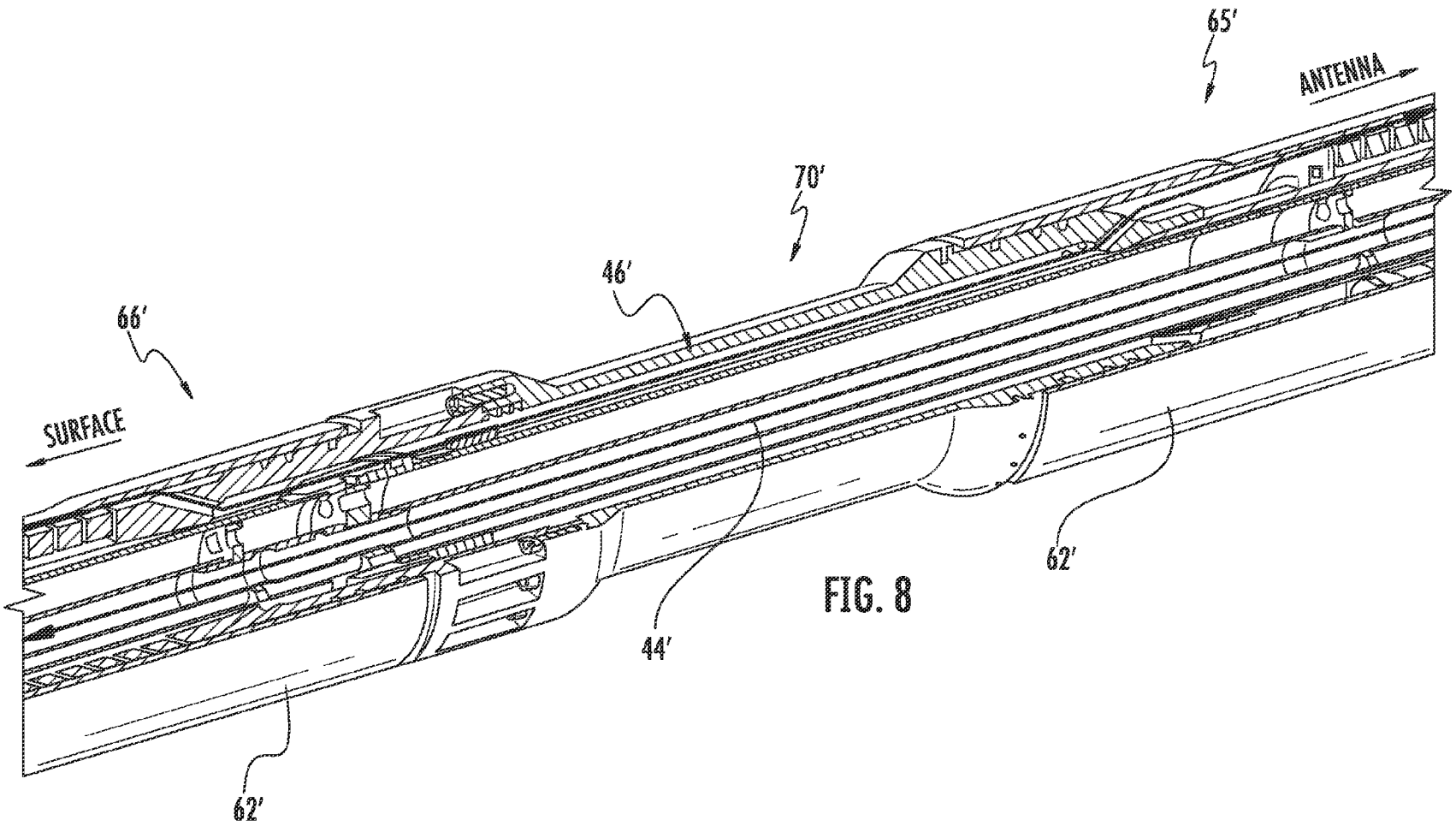
FIG. 8 is a cross-sectional perspective view of the bolted flange connection of the common mode choke assembly of FIG. 4.
Figure 9A:
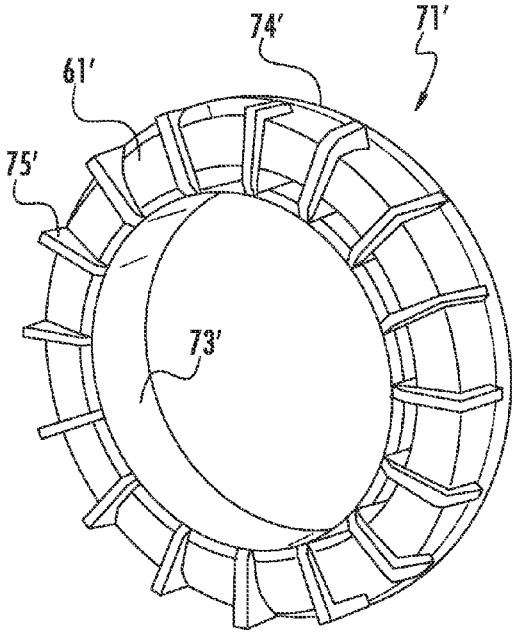
FIGS. 9*a* and 9*b* are respective front and back perspective views of a baffle and choke core arrangement providing for cooling fluid flow radially inner relative to the ring-shaped choke.
Figure 9B:
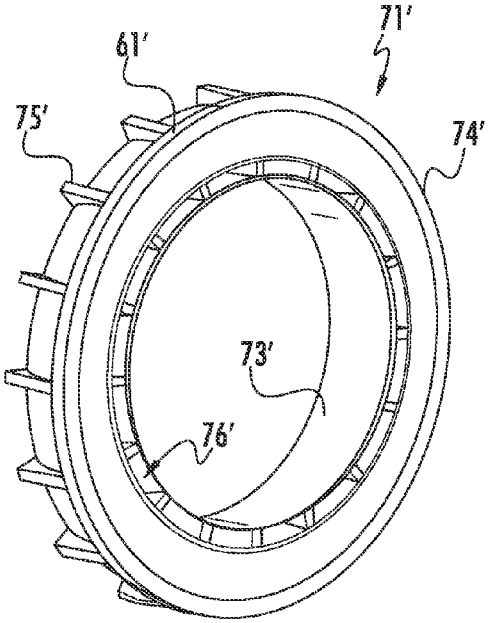
Figure 10A:
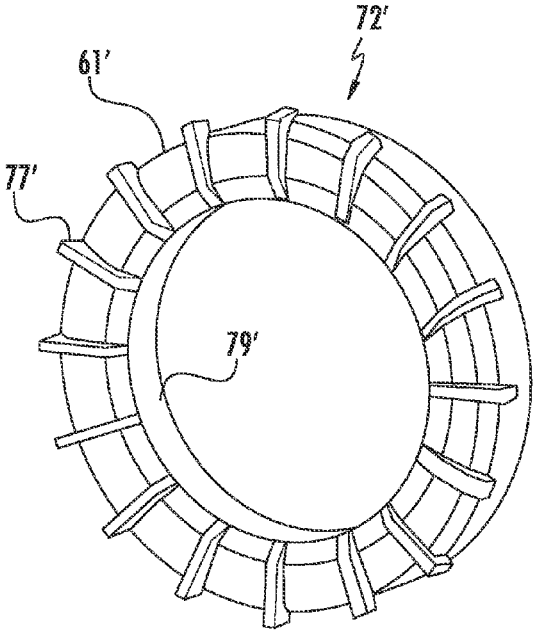
FIGS. 10*a* and 10*b* are respective front and back perspective views of a baffle and choke core arrangement providing for cooling fluid flow radially outer relative to the ring-shaped choke.
Figure 10B:
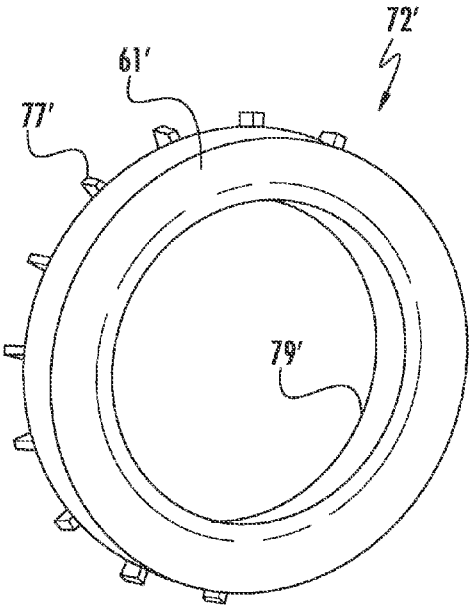

In the illustrated example, the first and second choke sections 65', 66' have different configurations of choke cores 61'. More particularly, the first choke section 65' includes three stages or sections of ring-shaped choke cores, a first stage (Stage 1) comprising a plurality (here 72) of 10 mm wide choke cores having a spacing of 0.115 inches (±0.005 inches) between adjacent cores for a total length of 1.01 m. In a second stage of the first choke 65' (Stage 2), there are a plurality (here 96) of 10 mm wide choke cores having a spacing of 0.125 inches (±0.025 inches) between adjacent cores for a total length of 1.33 m. In the third stage of the first choke 65' (Stage 3), there are a plurality (here 108) of 25 mm wide choke cores having a spacing of 0.125 inches (±0.025 inches) between adjacent cores for a total length of 3.11 m. The second choke section 65' has a single stage (Stage 4) including a plurality (here 192) of 25 mm wide choke cores having a spacing of 0.125 inches (±0.025 inches) between adjacent cores for a total length of 5.53 m. Other example dimensions for the illustrated choke core assembly 60' implementation are also shown in FIG. 7.

It should be noted that the dimensions, numbers of stages, choke core sizes, and spacings between choke cores provided in the above example may be different in different configurations. Generally speaking, the selection of these parameters will depend upon the power dissipation and operating temperature requirements of a given implementation. For example, wider choke core diameters may generally provide greater power dissipation, but with a relatively higher operating temperature. More particularly, a higher density of thinner choke cores within a given space provides more surface area for cooling, which may be desirable directly adjacent the antenna (e.g., Stage 1) where the choke power dissipation is highest and, thus, the greatest amount of heat is generated.

Moreover, wider spacing between adjacent choke cores provides for less of a pressure build-up in the cooling fluid circuit through the choke cores 61', and thus gradually increasing spacing between choke cores closer to the well head end of the choke assembly 60' may advantageously help keep pressure levels within the choke assembly within a desired range. As such, many combinations of core thickness and fluid gaps between the choke cores 61' are possible, as will be appreciated by those skilled in the art, although it may generally be helpful to include relatively thin choke cores near the antenna tip, and relatively thicker choke cores toward the "back" of the choke assembly 60' (i.e., the end closest to the well head).

The positioning and spacing of the choke cores 61' in the various stages of the choke assembly 60' may be facilitated by respective baffles 71' or 72', which may comprise a dielectric material, for example. The baffles 71', 72' not only serve as mounting fixtures for positioning respective choke cores 61' around the outer conductor 37', but they also may be configured to define the fluid gap spacing between adjacent cores and core positioning within the baffle. More particularly, the baffle 71' illustratively include an inner ring 73', an outer ring 74', and a plurality of radial arms 75' coupled between the inner and outer rings in which the choke core 61' rests. The radial arms 75' are shaped such that the choke core 61' is radially spaced apart from the inner ring 73', defining an inner fluid passageway 76' therebetween. That is, the cooling fluid will flow radially inside of the choke core 61' carried within the baffle 71'.

Similarly, the baffle 72' illustratively include an inner ring 79', and a plurality of radial arms 77' extending outward from the inner ring in which another choke core 61' rests. The radial arms 77' are shaped such that the choke core 61' is adjacent or in contact with the inner ring 79', defining an outer fluid passageway between the choke core and the sleeve 62'. That is, the cooling fluid will flow radially outside of the choke core 61' carried within the baffle 72'. Moreover, additional cooling fluid passageways may be defined in the ring 74' or the ring 76' to allow additional cooling fluid flow radially outside or inside a choke core 61', if desired. It will be appreciated that choke cores 61' with appropriate inner and outer diameters may be used for respective types of baffles 71', 72'.

Figure 11:
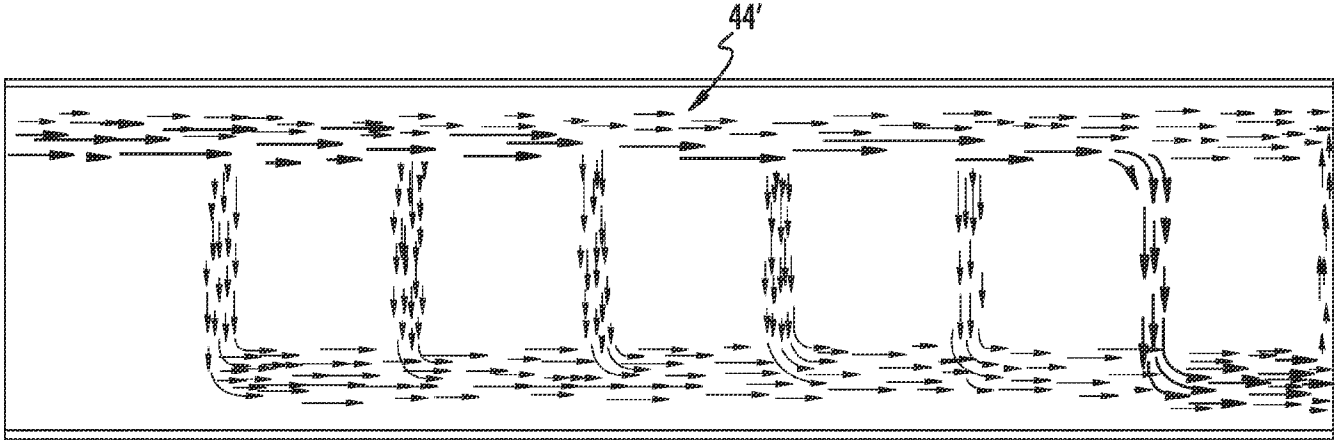
FIG. 11 is a cooling fluid velocity flow diagram illustrating fluid flow velocity in a portion of the cooling fluid path of the first common mode choke section of FIG. 5.
Figure 12:
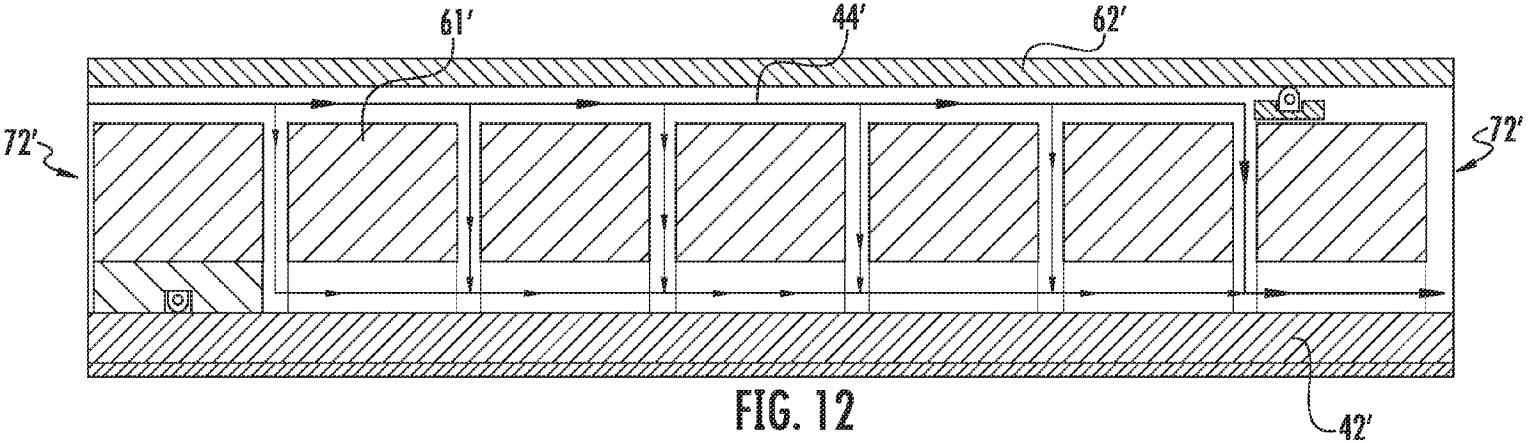
FIG. 12 is a schematic cross-sectional diagram illustrating the equivalent cooling fluid path for the thermal flow diagram of FIG. 11.

As such, by selecting the order in which the baffles 71', 72' are positioned on the outer conductor 37', different cooling circuit flow paths may be defied. With reference to FIGS. 11 and 12, a "parallel" flow path is provided by positioning a series of six baffles 72' in a row so that the main flow path for cooling fluid 44' is radially outward of the choke cores 61', followed by a baffle 71'. FIG. 11 illustrates the velocity of cooling fluid flow, while FIG. 12 mechanically illustrates the flow path of the cooling fluid circuit. The inner baffles also permit cooling fluid flow radially inward of the chokes 61' to provide the parallel flow between the chokes 61'. However, it will be appreciated that various different flow configurations may be used. For example, alternating baffles 71', 72' could be used to provide a serial or serpentine flow path through the choke cores 61', or a combination of serial and parallel flow paths may be used within the same choke assembly 60'. Generally speaking, a serial flow path may provide for increased cooling of the choke cores 61', but at the expense of increased pressure in the cooling fluid circuit. As such, the particular cooling fluid path used in a given implementation may be selected depending upon the given cooling and pressure parameters for the implementation, as will be appreciated by those skilled in the art.

With respect to the choke cores 61', one example class of materials which may be used to form the cores are nanocrystalline materials. Nanocrystalline materials may provide significant performance improvement over other inductive materials such as ferrites (e.g., higher saturation flux density, higher permeability, better thermal stability, lower losses, etc.), although such materials are typically more expensive than ferrites. By way of example, one such nanocrystalline material which may be used in the choke cores 61 or 61' are the VITROPERM® line of nanocrystalline alloys from VACUUMSCHMELZE GmbH & Co. KG of Hanau, Germany. However, other suitable nanocrystalline materials, ferrite materials, etc., may also be used for the embodiments described herein, as will be appreciated by those skilled in the art. Furthermore, in some implementations is may be desirable to provide a protective coating or covering on the choke cores 61, 61' to enhance longevity and thermal stability of the cores, such as an epoxy coating. By way of example, a high temperature epoxy such as Araldite 2014-1 or Araldite 2052 from Huntsman Advanced Materials of The Woodlands, Tex., may be used although other suitable coating materials may also be used.

Figure 13:
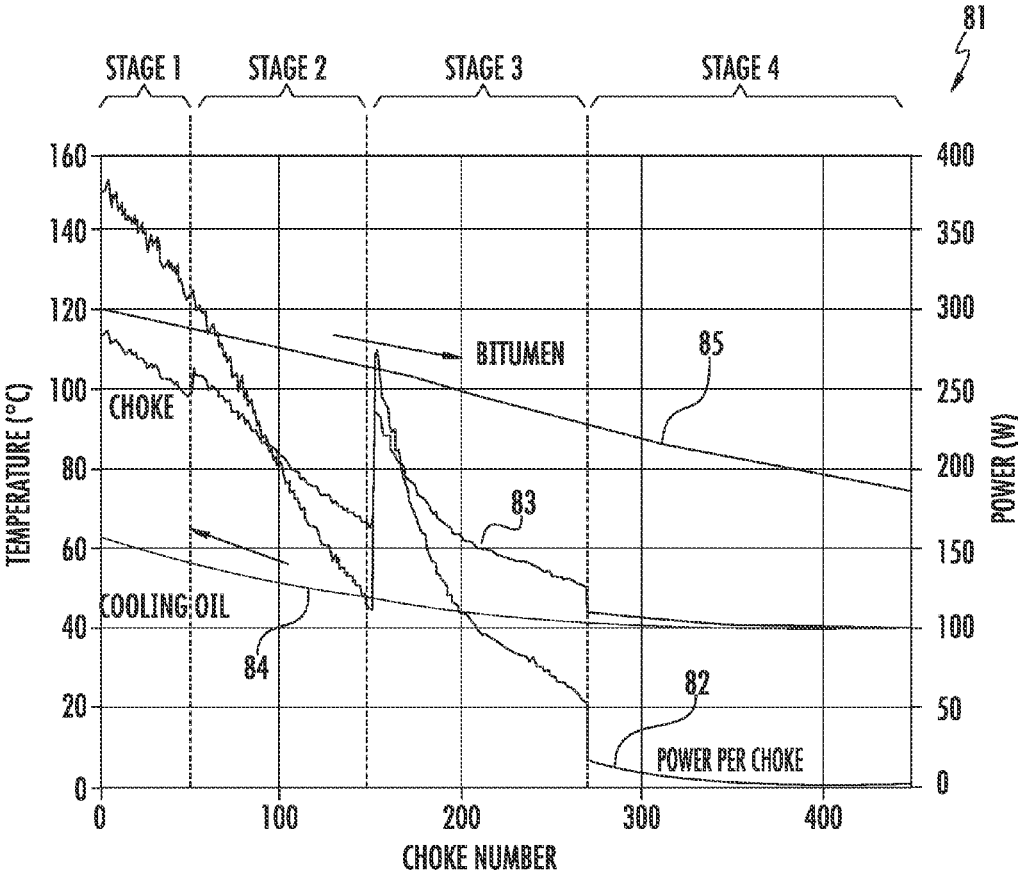
FIG. 13 is a graph illustrating power and heat dissipation for the common mode choke assembly of FIG. 4.

A modeled power dissipation curve 82 and temperature dissipation curve 83 for the choke assembly 60' illustrated in FIG. 7 are shown in the graph 81 of FIG. 13. In the graph 81, dashed vertical lines indicate the transition between the various stages of the choke assembly 60', which are labeled above the graph. The scale for the power dissipation curve 82 is provided at the right-hand side of the graph, while the scale for the temperature dissipation curve 83 is provided at the left-hand side of the graph. Similarly, respective modeled temperature curves 84, 85 for the cooling fluid (here mineral oil) and bitumen adjacent the choke assembly 61' also share the temperature scale at the left-hand side of the graph 81. In the example embodiment, a cooling flow rate of twenty five gallons per minute was used, along with an operating power of 400 kW at 0.8 MHz.

Figure 14:
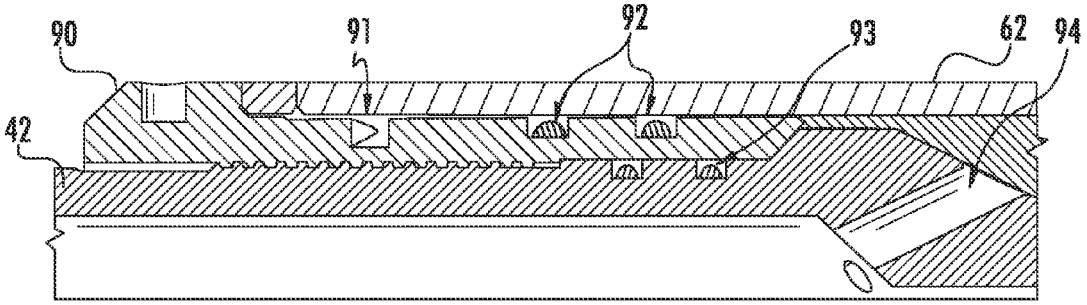
FIG. 14 is a partial cross-sectional view illustrating an example interface for the first and second common mode choke sections of the common mode choke assembly of FIG. 4.

An example threaded crossover fitting which may be used to interconnect the choke assemblies 60 (or 60') with adjacent transmission line sections is shown in FIG. 14. An outer threaded member 90 has a recessed portion for receiving the dielectric sleeve 62, and it treads on to the tubular 42 of an adjoining transmission line segment. The dielectric sleeve 62 is sealed with the outer threaded member 90 via a symmetrical lip seal 91 and one or more O-rings 92 as shown, and the outer threaded member is sealed with the tubular 42 via one or more O-rings 93. By way of example, the seal 91 may be a Parker 1289-85-20-07000 Symmetrical Lip Seal (Material: V1289-75); the O-rings 92 may be a Parker 2-441 O-ring, Ø 0.275" and ID 6.975" (Material: VW252-65); and the O-rings 93 may be Parker 2-362 O-rings, Ø 0.210" and ID 6.225" (Material: VW252-65), although other suitable components and sealing configurations may also be used in different embodiments. The tubular 42 also illustratively includes a cooling fluid flow port 94 which allows cooling fluid to be supplied from the cooling fluid source 50 to the choke assembly 60, as described above.

Figure 15:
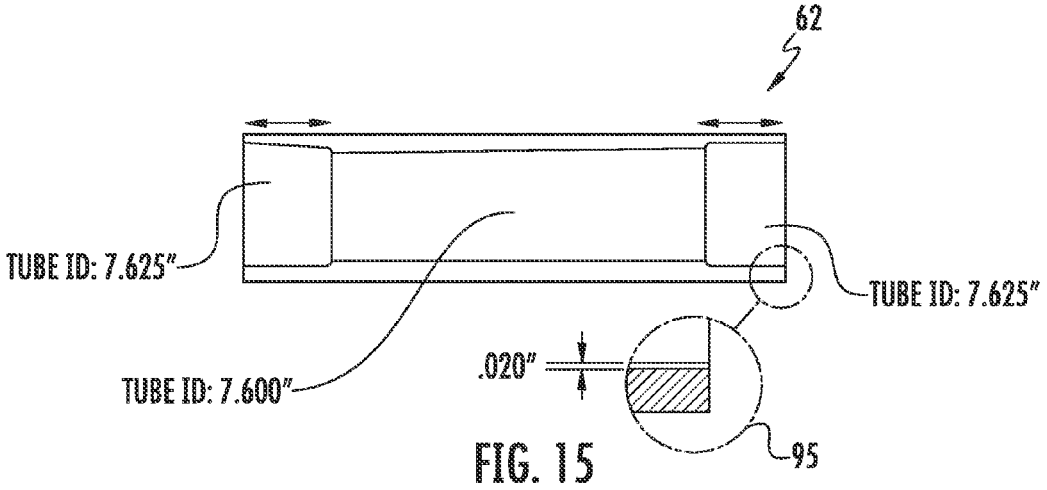
FIG. 15 is a side view of illustrating example features and dimensions of a dielectric sleeve which may be used with the first and second common mode choke sections of the common mode choke assembly of FIG. 4.
Figure 16:
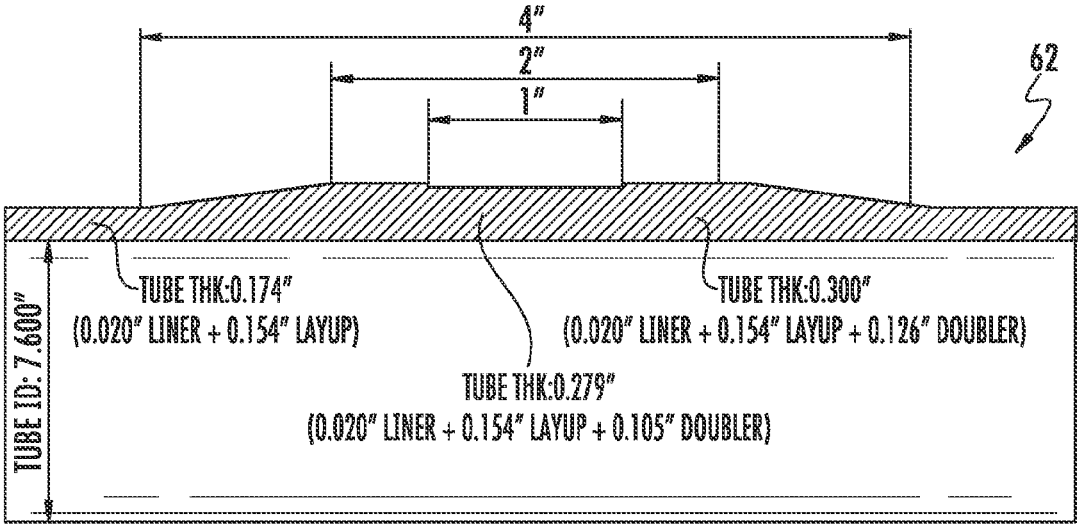
FIG. 16 is a are cross-sectional diagram of the sleeve of FIG. 15 illustrating further example features and dimensions thereof.

An example implementation of the sleeve 62 is now described with reference to FIGS. 15-16. As shown within the inset 95 of FIG. 15, a thin "liner" (e.g., 0.020" thick) including, for example, an 80% RS-9 resin rich quartz veil may be added on the inner surface of the sleeve 42. This liner may advantageously provide a smoother surface suitable for O-ring sealing, and a fluid barrier to help prevent the liquid media under pressure from seeping through the structural wall of the composite tube, for example. However, such a liner need not be used in all embodiments. During assembly for positioning in the wellbore, removable end adapters may be attached to the end of the mandrel to reduce the potential for scratches to the sleeve 42 during mandrel removal, as will be appreciated by those skilled in the art. Furthermore, an external pocket may be defined on the sleeve 62 (FIG. 16) to allow for an external clamp to be retained with reduced clamping force during positioning within the wellbore, as will also be appreciated by those skilled in the art. It should be noted that different dimensions and features besides those shown in FIGS. 15 and 16 may be used in different embodiments.

Figure 17:
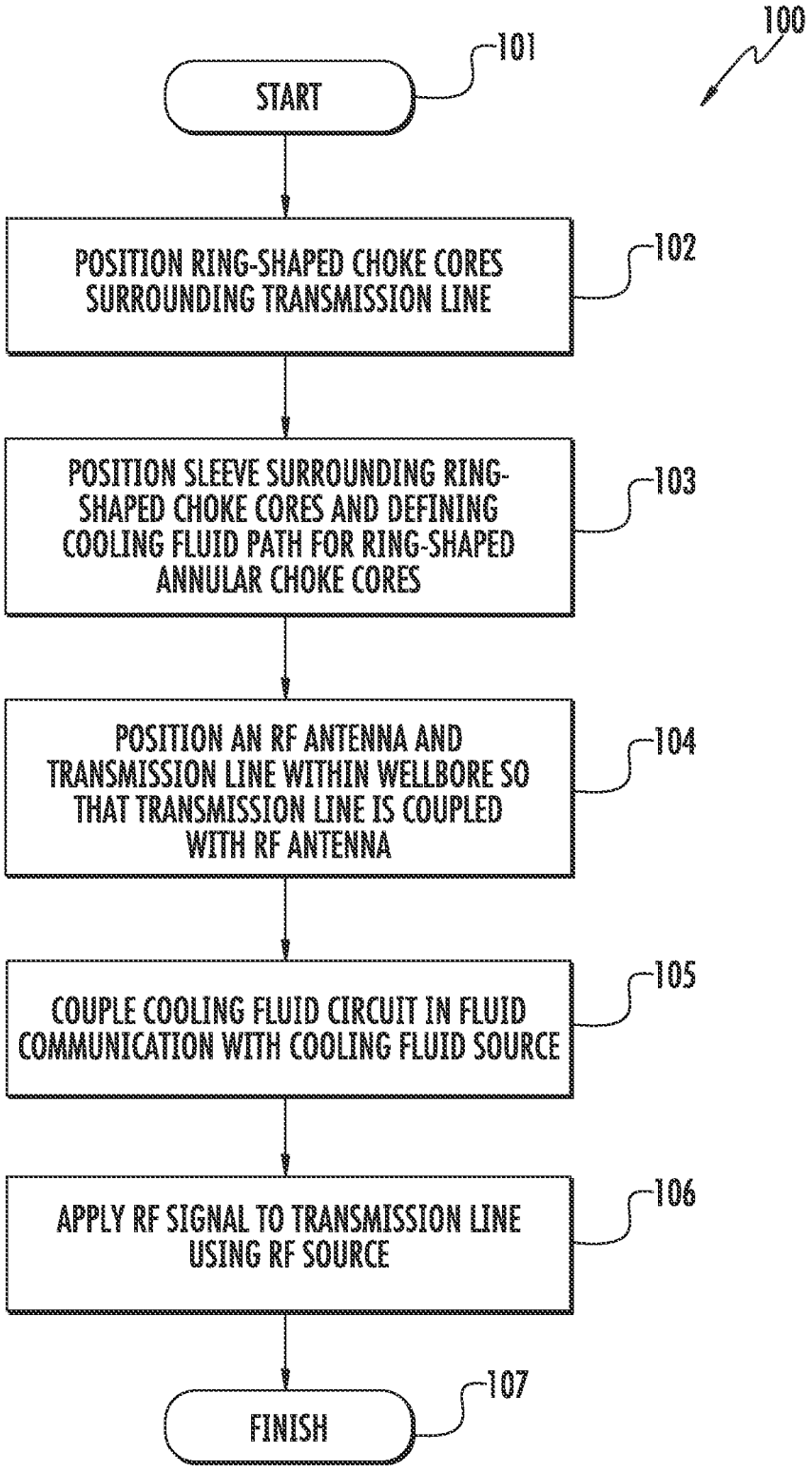
FIG. 17 is a flow diagram illustrating an example method for heating a hydrocarbon resource in a subterranean formation.

A related method for heating a hydrocarbon resource in a subterranean formation 32 having a wellbore extending therein is now described with reference to the flow diagram 100 of FIG. 17. The method begins (Block 101) with positioning a plurality of ring-shaped choke cores 61 surrounding a transmission line 38, and positioning a sleeve 62 surrounding the plurality of ring-shaped choke cores and defining a cooling fluid path for the plurality of ring-shaped choke cores (Blocks 102-103), as described above. Here again, the various transmission line 38 and choke assembly 60 components may be manufactured off-site and shipped to the well site for assembly and positioning in the wellbore with the RF antenna 35, at Block 104, as will be appreciated by those skilled in the art. Furthermore, the cooling fluid circuit may be coupled in fluid communication with a cooling fluid source 50, at Block 105, and an RF signal may be applied to the transmission line 38 using the RF source 34, at Block 106. As noted above, the heated hydrocarbon resource 31 may then more readily flow to a recovery line within the same wellbore, or through a separate collection wellbore, for extraction to the surface. In some embodiments, a supply line(s) 99 may be used to supply a solvent into the wellbore to further aid in the hydrocarbon resource extraction, as will be appreciated by those skilled in the art. The method of FIG. 17 illustratively concludes at Block 107.

It will therefore be appreciated that the above-described systems and methods provide for a relatively compact common mode choke assembly 60 (or 60') for broadband common mode suppression in a subterranean antenna system. Generally speaking, as a result of formation changes, the impedance of the antenna 35 will change over time, and thus the ability to change frequency and impedance matching characteristics over the course of time may result in greater recovery success than single frequency of operation. The broadband nature of the choke assembly 60 enables antenna operation over a wide range of frequency and allows the antenna 35 to operate at a most efficient frequency over a relatively large operating frequency range while rejecting common mode current. Moreover, the integral choke liquid cooling system described above uses the chokes as elements of a fluid cooled heat exchanger to provide high performance despite the relatively poor anisotropic thermal conductivity of typical choke elements. As described above, the cooling system is configurable in a number of ways to uniquely match the thermal need of the particular antenna system. Moreover, the modular approach to the choke assembly allows for flexibility to balance heat transfer requirements without excessive flow pressure drop.

As a result, the system 30 and associated choke assembly 60 may provide a number of operational advantages. For example, it may provide a relatively high impedance to the antenna 35 to prevent common mode currents on the transmission line 38, maintaining adequate high voltage standoff. Moreover, this configuration may advantageously allow for removal of generated heat without excessive fluid pressure drop, yet within a package that is deployable on a completions rig that will "turn the bend" without damage. The relatively compact nature of the choke assembly 60 may provide for a relatively short length, and less joints. Furthermore, the choke assembly 60 may be fully factory built and tested, so that the choke assembly may be at "factory condition" at the time of installation, and it may help prevent exposure to high voltage components during integration.

Again, the modular nature of the choke assembly 60 allows for more choke sections to be added for higher power applications, for example.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for heating a hydrocarbon resource in a subterranean formation having a wellbore extending therein, the system comprising:

a radio frequency (RF) antenna configured to be positioned within the wellbore;

an RF source;

a cooling fluid source at the surface of the subterranean formation outside the wellbore;

a transmission line coupled between said RF antenna and said RF source;

a plurality of ring-shaped choke cores surrounding said transmission line;

a plurality of baffles, each spacing an adjacent pair of ring-shaped chokes apart; and a sleeve surrounding said plurality of ring-shaped choke cores and baffles and defining a cooling fluid path for said plurality of ring-shaped choke cores and in fluid communication with said cooling fluid source;

wherein at least one of the plurality of baffles comprises radially inner and outer dielectric rings defining a gap between the radially inner and outer rings in which a respective ring-shaped choke core rests, and wherein the inner dielectric ring has a plurality of inner fluid passageways within the inner dielectric ring defining portions of the cooling fluid path.

2. The system of claim 1 wherein said transmission line comprises a coaxial transmission line also coupled in fluid communication with said cooling fluid source.

3. The system of claim 1 wherein at least one other baffle comprises a radial inner ring and a plurality of radial arms extending outward from the inner ring in which a respective ring-shaped choke rests, the radial arms defining a plurality of outer fluid passageways radially outside of the respective ring-shaped choke and defining portions of the cooling fluid path.

4. The system of claim 1 wherein at least one other baffle comprises radial inner and outer rings defining a gap between the radially inner and outer rings in which a respective ring-shaped choke core rests, and wherein the outer dielectric ring has a plurality of outer fluid passageways within the outer dielectric ring defining portions of the cooling fluid path.

5. The system of claim 1 wherein said plurality of ring-shaped choke cores comprises a first group of ring-shaped choke cores each having a first width, and a second group of ring-shaped choke cores each having a second width different than the first width.

6. The system of claim 1 wherein said plurality of ring-shaped choke cores comprises a first group having a first spacing between corresponding adjacent ring-shaped chokes, and a second group having a second spacing between corresponding adjacent ring-shaped choke cores different than the first spacing.

7. The system of claim 1 wherein said sleeve comprises a dielectric material.

8. The system of claim 1 wherein said plurality of ring-shaped choke cores each comprises a nanocrystalline magnetic material.

9. The system of claim 1 further comprising a tubular surrounding said transmission line, and wherein said plurality of ring-shaped choke cores surround the tubular.

10. A choke assembly to be coupled with a radio frequency (RF) antenna to be positioned within a wellbore in a subterranean formation to heat a hydrocarbon resource, the choke assembly comprising:

a transmission line to be coupled between the RF antenna and an RF source within the wellbore in the subterranean formation;

a plurality of ring-shaped choke cores surrounding said transmission line;

a plurality of baffles, each spacing an adjacent pair of ring-shaped chokes apart; and a sleeve surrounding said plurality of ring-shaped choke cores and baffles and defining a cooling fluid path for said plurality of ring-shaped choke cores to be connected in fluid communication with a cooling fluid source at the surface of the subterranean formation outside the wellbore;

wherein at least one of the plurality of baffles comprises radially inner and outer dielectric rings defining a gap between the radially inner and outer rings in which a respective ring-shaped choke core rests, and wherein the inner dielectric ring has a plurality of inner fluid passageways within the inner dielectric ring defining portions of the cooling fluid path.

11. The choke assembly of claim 10 wherein said transmission line comprises a coaxial transmission line also to be coupled in fluid communication with the cooling fluid source.

12. The choke assembly of claim 10 wherein at least one other baffle comprises a radial inner ring and a plurality of radial arms extending outward from the inner ring in which a respective ring-shaped choke rests, the radial arms defining a plurality of outer fluid passageways radially outside of the respective ring-shaped choke and defining portions of the cooling fluid path.

13. The choke assembly of claim 10 wherein at least one other baffle comprises radial inner and outer rings defining a gap between the radially inner and outer rings in which a respective ring-shaped choke core rests, and wherein the outer dielectric ring has a plurality of outer fluid passageways within the outer dielectric ring defining portions of the cooling fluid path.

14. The choke assembly of claim 10 wherein said plurality of ring-shaped choke cores comprises a first group of ring-shaped choke cores each having a first width, and a second group of ring-shaped choke cores each having a second width different than the first width.

15. The choke assembly of claim 10 wherein said plurality of ring-shaped choke cores comprises a first group having a first spacing between corresponding adjacent ring-shaped chokes, and a second group having a second spacing between corresponding adjacent ring-shaped choke cores different than the first spacing.

16. A method for heating a hydrocarbon resource in a subterranean formation having a wellbore extending therein, the method comprising:

positioning a plurality of ring-shaped choke cores and a plurality of baffles surrounding a transmission line, each baffle spacing an adjacent pair of ring-shaped choke cores apart, and positioning a sleeve surrounding the plurality of ring-shaped choke cores and baffles and defining a cooling fluid path for the plurality of ring-shaped choke cores;

positioning a radio frequency (RF) antenna and the transmission line within the wellbore so that the transmission line is coupled with the RF antenna;

coupling the cooling fluid path in fluid communication with a cooling fluid source at the surface of the subterranean formation outside the wellbore; and applying an RF signal to the transmission line using an RF source;

wherein at least one of the plurality of baffles comprises radially inner and outer dielectric rings defining a gap between the radially inner and outer rings in which a respective ring-shaped choke core rests, and wherein the inner dielectric ring has a plurality of inner fluid passageways within the inner dielectric ring defining portions of the cooling fluid path.

17. The method of claim 16 wherein the transmission line comprises a coaxial transmission line; and further comprising coupling the coaxial transmission line in fluid communication with the cooling fluid source.

18. The method of claim 16 wherein at least one other baffle comprises a radial inner ring and a plurality of radial arms extending outward from the inner ring in which a respective ring-shaped choke rests, the radial arms defining a plurality of outer fluid passageways radially outside of the respective ring-shaped choke and defining portions of the cooling fluid path.

19. The method of claim 16 wherein at least one other baffle comprises radial inner and outer rings defining a gap between the radially inner and outer rings in which a respective ring-shaped choke core rests, and wherein the outer dielectric ring has a plurality of outer fluid passageways within the outer dielectric ring defining portions of the cooling fluid path.

20. The method of claim 16 wherein positioning the plurality of ring-shaped choke cores comprises positioning a first group of ring-shaped choke cores each having a first width surrounding the transmission line, and positioning a second group of ring-shaped choke cores each having a second width different than the first width surrounding the transmission line.

21. The method of claim 16 wherein positioning the plurality of ring-shaped choke cores comprises positioning a first group having a first spacing between corresponding adjacent ring-shaped chokes, and positioning a second group having a second spacing between corresponding adjacent ring-shaped choke cores different than the first spacing.

* * * * *